United States Patent [19]

Lotter et al.

[11] Patent Number: 4,565,989

[45] Date of Patent: Jan. 21, 1986

[54] TEMPERATURE CONTROL APPARATUS

[75] Inventors: Bruno Lotter, Oberderdingen; Willi Essig, Böblingen; Hans Mayer, Kuernbach, all of Fed. Rep. of Germany

[73] Assignee: E.G.O. Elektro-Gerate Blanc u. Fischer, Fed. Rep. of Germany

[21] Appl. No.: 547,787

[22] Filed: Nov. 2, 1983

[51] Int. Cl.[4] ..... H01H 37/36

[52] U.S. Cl. ..... 337/311; 337/310; 337/320

[58] Field of Search ..... 337/309, 310, 311, 312, 337/320, 321, 323, 117, 118, 119, 114, 122

[56] References Cited

U.S. PATENT DOCUMENTS

| | | | |
|---|---|---|---|
| 2,758,177 | 8/1956 | Eskin | 337/310 |
| 2,804,525 | 8/1957 | Mantz | 337/310 |
| 2,885,513 | 5/1959 | Judd | 337/320 |
| 3,050,600 | 8/1962 | Booth et al. | 200/81.4 |
| 3,235,692 | 2/1966 | Kuceva | 200/140 |
| 3,245,262 | 4/1966 | Snoberger | 337/311 |
| 3,858,139 | 12/1974 | Hunter | 337/88 |

FOREIGN PATENT DOCUMENTS

| | | |
|---|---|---|
| 1440849 | 10/1969 | Fed. Rep. of Germany . |
| 2619749 | 11/1977 | Fed. Rep. of Germany . |

*Primary Examiner*—Harold Broome

*Attorney, Agent, or Firm*—Steele, Gould & Fried

[57] ABSTRACT

A temperature control apparatus, for example a hydraulic temperature regulator or thermal cut-out, comprises three interchangeably interconnected subassemblies, namely: a box-like sheet metal casing with an adjusting mechanism; an operating member comprising a hydraulic expansion box and a transmission lever with overload protection; and, a plurality of switch components to be inserted in holders on the casing. The switch components comprise a snap switch base and a snap switch operationally fitted therein, together with the corresponding flat connecting pieces.

One or more of such snap switch subassemblies can be fitted to the casing, in order to provide a single-pole or multipole switch.

13 Claims, 3 Drawing Figures

TEMPERATURE CONTROL APPARATUS

BACKGROUND OF THE INVENTION

1. Field of the Invention

The invention relates to a temperature control apparatus with a casing, which has holders or receptacles for several snap switches and an operating member arranged in the casing, and which comprises an expansion element and a transmission mechanism for acting on one or more of the snap switches.

2. Prior Art

Such a thermostat is known from British Pat. No. 940,105, corresponding to U.S. Pat. No. 3,245,262, wherein several snap switches are arranged in parallel to one another in an insulating part, which covers one side of the box-like casing and which itself forms a box which is open at the top. The four juxtaposed snap switches are covered by a common insulating cover, which carries the connections for the snap switches. Thus, a switch is formed with a plurality of independently operable snap switches. In practice, numerous different thermostats are required, which are essentially identically constructed, but which differ through the number and nature of the contacts to be switched (e.g. closing or reversing switches), as well as through the nature of their operation (setting by means of a regulator spindle or set once and for all), while in part fulfilling special requirements (e.g., security against leaks, safety cut-outs).

This leads to such a multiplicity of types that, despite the large numbers produced, it is still impossible to use the most economically advantageous manufacturing methods. In addition, even one faulty component or non compliance with one tolerance means that the complete unit must be rejected as waste at the time of the final inspection.

It is also known to operate juxtaposed snap switches by means of a common transmission lever, each of the switches having its own casing (U.S. Pat. Nos. 3,050,600 and 3,235,692).

SUMMARY OF THE INVENTION

The object of the present invention is to provide a temperature control apparatus which can be manufactured more profitably and with minimum waste.

According to the invention, this object is achieved in that each snap switch has an insulating snap switch base and forms an independent and separate component, which can be connected in module-like manner in the casing to form either a single-pole or a multipole temperature control apparatus or thermostat.

This makes it possible to produce a large number of switch variants while only using a few modules and without increasing the overall expenditure for the switch. Thus, using the same casing and operating mechanism, it is possible to produce one-pole to three-pole switches with only one snap switch module type.

Advantageously, the operating member can be arranged as an interchangeable unit on the casing. This leads to a further increase in the number of possible variants, because together with the same casing and switch modules, it is now possible to employ different operating members, e.g. with expansion boxes of different types and sizes, and with compensation or protection means against leaks in the hydraulic system. If, in addition, a number of different casing types with the same connection dimensions are provided (e.g. with a manually adjustable regulator spindle or push button resetting of a safety switch), it is possible to construct dozens of different versions of temperature control apparatus through the module-like combination of the basic modules. The apparatus is constructed in such a way that it is not necessary to always use all the snap switch bases forming the switch modules. The corresponding sections can be left free, if they are not required. It is advantageous in this connection to provide on the casing an insert, which is preferably made from insulating material and which has channel-like or box-like holders or receptacles on its outwardly directed side. The snap switch bases can be inserted in these holders or receptacles from the outside in such a way that each snap switch is located in such a channel-like or box-like holder and the snap switch base seals the latter towards the outside. However, the holders also form an insulating seal for the interior of the casing.

The snap switch bases can be narrow, elongated subassemblies, several of which are juxtaposed in parallel in the holders. If they are arranged in this way, the juxtaposed snap switch bases at least partly seal one side of the casing. Thus, the casing need only be formed from a cup-shaped sheet metal part, whose open side is closed on the one hand by the insert and on the other by the snap switch bases. Preferably, each snap switch base carries the external connections for its snap switch, so that it is electrically self-supporting and no electrical connections are required within the switch or between the individual snap switches to enable the snap switch to function.

According to an advantageous embodiment of the invention, the operating member preferably has a plate-like lever, to which is fitted the expansion element and, in an optionally adjustable manner, at least one transmission ram for acting on the snap switches. It can be advantageous in this case for the operating member to be interchangeably fitted to the casing by a spindle supporting the lever and which is in turn mounted in the casing walls.

According to another further preferred embodiment, each transmission ram can be fitted to an individual spring tongue, which preferably forms part of a comb-like spring plate arranged parallel to the lever and which is advantageously adjustable by an adjusting screw supported on said lever. As a result of this arrangement, an overload protection for the snap switch is obtained. The spring tongue is strong enough to ensure a clearance-free transmission of the movement of the expansion element, via the transmission ram to the snap switch or switches, but can give way if the snap switch has already been operated and the expansion element expands further, which is the case with multipole snap switches operating at different temperatures. It also permits the very advantageous arrangement of an adjusting screw.

BRIEF DESCRIPTION OF THE DRAWINGS

Features of preferred embodiments of the invention can be seen in the drawings. The individual features can be utilized singly or in the form of different subcombinations. Such embodiments of the invention are described in greater detail hereinafter, with reference to the drawings, wherein.

DETAILED DESCRIPTION OF THE PREFERRED EMBODIMENTS

Figure 1:
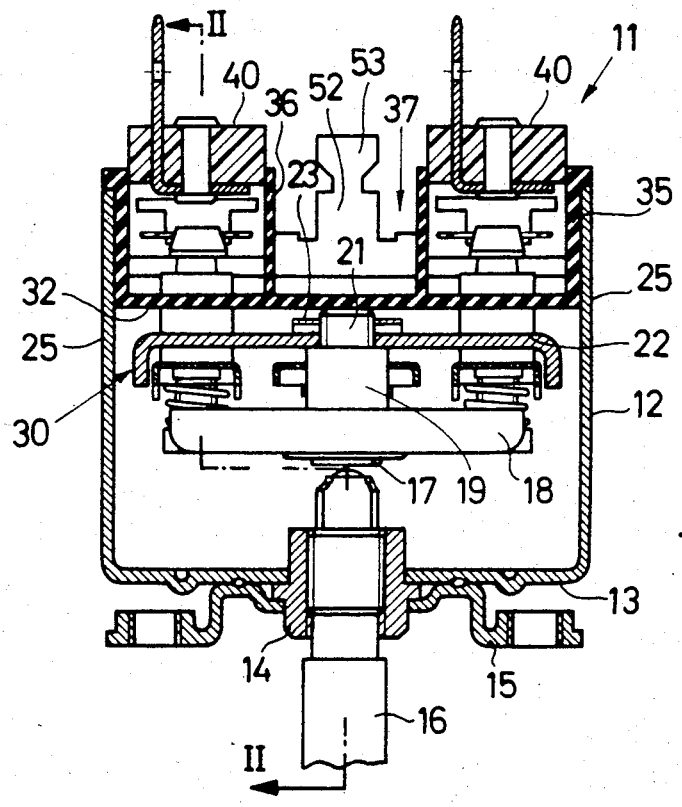
FIG. 1 is a section through a temperature control apparatus taken along line I—I of FIG. 2.
Figure 2:
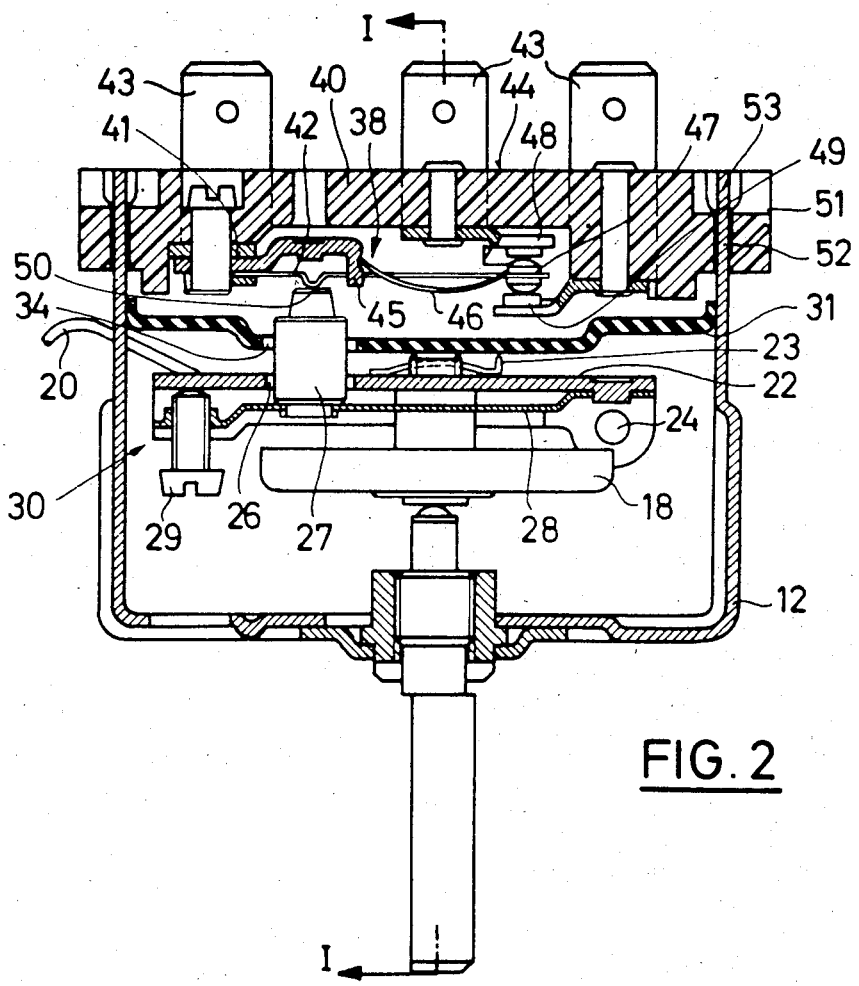
FIG. 2 is a section taken along line II—II of FIG. 1.

The temperature control apparatus shown in FIGS. 1 and 2 is intended for use as a single-pole or multipole thermostat or thermal cut-out, which is either adjustable or set once and for all. It has a casing 12 shaped like a rectangular or square sheet metal box, in whose bottom 13 is inserted an adjustment nut 14 and is secured by a welded-on fixing plate 15. A portion of an adjusting shaft 16, provided with an adjustment thread, is screwed into the adjustment nut. The outwardly projecting end of the adjusting shaft 16 has a flattened portion for the non-rotary reception of an adjustment knob (not shown), while its inner end presses against a pressure surface 17 of an adjustment member 18 constructed as a siphon diaphragm. The expansion element is a conventional expansion box, which comprises two corrugated metal diaphragms, welded to one another in the edge area. One side of the expansion box is welded to the pressure surface 17 and the other side is welded a connecting piece 19. A capillary tube 20 leads into connecting piece 19 and connects the expansion element to a conventional temperature sensor (not shown), e.g. a capsule-like or tubular sensor. The cylindrical connecting piece 19 has a fixing portion 21 of reduced diameter projecting through an opening of a plate-like lever 22, which has a chamfered rim for reinforcements purposes on two of its edges. The exapansion box is fixed to lever 22 by a quick-action attachment member 23. The lever is pivotable about a spindle 24, which is mounted in the upwardly tilted edge of the lever and into side walls 25 of the casing. The casing has three juxtaposed holes 26 on the side pointing towards the free end of the lever and through which the insulating material pressure pieces 27 project. At its lower end in the drawing, they are recessed and receive in corresponding grooves in each case one spring tongue 28 which, on the side of the lever 22 facing expansion element 18 run parallel thereto and are riveted to the lever in the vicinity of the spindle. An adjustment screw 29 is screwed into the free end of each spring tongue 28. Screw 29 is supported on lever 22 and makes it possible to set the relative position of the spring tongue with respect to the lever. The three parallel spring tongues are interconnected at the riveted end, so that they project in comb-like manner from the fixing end. They can also be reinforced by an upwards bending of the edge over the major portion of the length thereof and only the portion located shortly before the fixed end thereof behaves in a hinge-like manner.

It can be seen that the expansion element 18, the lever 22 with the spring tongues fitted thereto and the pressure pieces 27 form a cohesive unit, which constitutes an operating member 30. Operating member 30 may be manufactured as a preset, separate unit and can be fixed by inserting spindle 24 into casing 12.

An insert 31 is hung in the open side of the box-like casing 12 and is supported by a flange on the side walls. Alternately, insert 31 can be fixed by the inwardly directed metal strips of the casing. The plastic insert 31 is relatively thin and has a bottom 32, which terminates the open side of the casing at a certain distance from the upper edge of side walls 25, with the exception of three holes 34 for pressure pieces 27. Walls 35, which are parallel to side walls 25 and insert partitions 36, define three elongated, parallel channels or chambers having a roughly square cross-section, which form three receptacles or holders 37 for the switches of the thermostat or temperature control apparatus.

These switches are constructed as single snap switches 38 and are fitted to the underside of a ledge-like, snap switch base 40 made of insulating material. The snap switch bases are preferably made from a ceramic insulating material, e.g. steatite, but with more limited thermal requirements can be made from plastic. Special manufacturing advantages result from the ledge-like construction with a flat recess in the center when made from steatite. Each snap switch 38 has a rigid snap switch support 41, which is screwed to the snap switch base 40 and to whose one end is fixed a catch spring 42. From there, the power is supplied to the catch spring by means of a flat connecting tongue 43, which projects through a slot in the snap switch base, whose inner end is bent round and placed beneath the snap switch support 41. There are in all three flat connecting tongues 43, which project outwards over the substantially planar outer face 44 of each snap switch base.

At its end remote from the fixture, the snap switch support 41 has a downwardly bent step bearing 45 for a spring tongue 46, which is part of the catch spring 42 and is supported under bending pretension in the step bearing. On each side, the free end of the catch spring carries a contact 47, which can alternately cooperate with two opposite contacts 48, 49 in both switching positions. The opposite contacts are directly provided on the downwardly bent ends of the corresponding flat tongues 43 and are fixed by rivets to the snap switch base.

Thus, the snap switch base, together with the snap switch mounted thereon and the connections, forms an independent switching unit which can be operated by a pressure piece 27, which acts on an operating pressure point 50. It can be fixed to casing 12 by means of slots 51 provided on its two ends, through which the projecting sheet metal strips 52 extend beyond the casing and are secured by turning the notched upper portion 53.

Each snap switch base seals or closes off one of the reception chambers 37, so that the snap switch is protected in said chamber and is shielded from the outside. Due to the fact that the snap switches are independently operable and connectable, it is also unnecessary to fit all the three snap switches provided. Thus, it can be seen in FIG. 1, that in the present embodiment only the two outer snap switches are provided, while the central chamber 37 remains free and no pressure piece 27 is inserted for the control chamber. Thus, a two-path regulator is formed. As it is fundamentally also possible to provide a double snap switch with two independently operable contacts on the snap switch base, in the case of the represented switch construction, it is possible to vary construction between a single-pole and a six-pole thermostat. It is also being possible for each pole to be constructed as a reversing switch (from opposite contact 48 to 49), as shown in FIGS. 1 and 2. Thus, the thermostat comprises three subassemblies i.e. casing 12 with operating means 14, 16 and insert 31, operating member 30 with the expansion element and transmission means 22, 27, 28, and finally a plurality of identically constructed snap switch bases 40 with snap switches 38 and connections 43. Thus, it is possible to manufacture a large number of regulator types from a few individual components of a few basic subassemblies according to the specific requirements of customers. By reducing the number of parts and introducing a modular system, it is not only possible to greatly simplify manufacture and storage requirements, but to increase quality and reduce waste. Thus, for example, the operating characteristics of the switch subassembly can be checked prior to the assembly of the thermostat and each subassembly can be preset (operating member 30).

Figure 3:
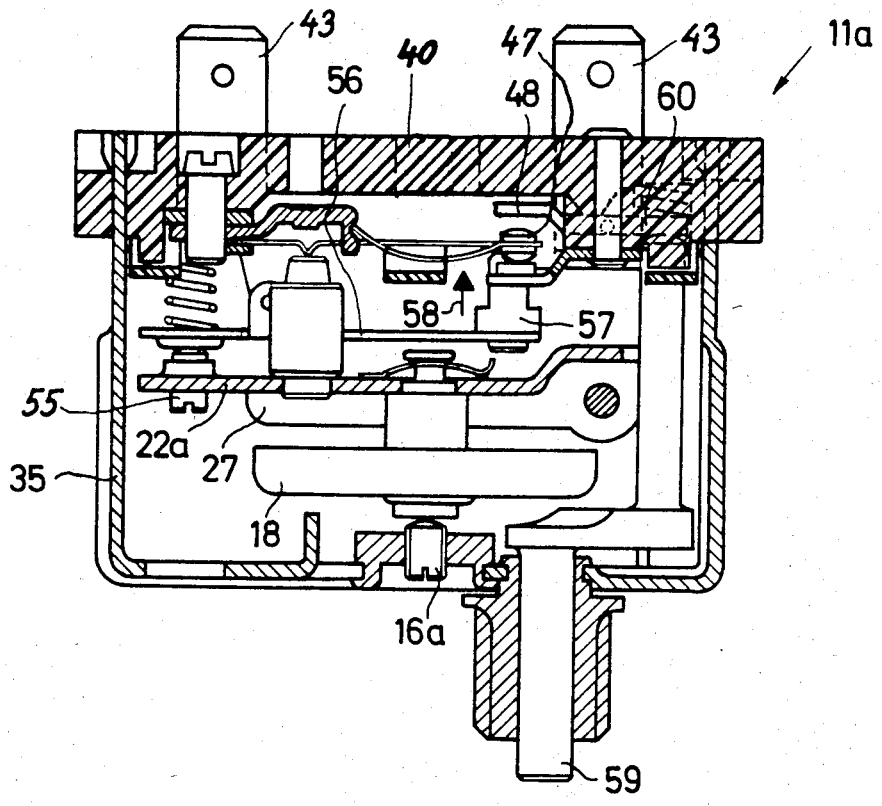
FIG. 3 is a section through a modified embodiment taken along the same section line as in FIG. 2.

To illustrate the number of possible variants, FIG. 3 shows a thermostat 11*a*, which is used as a non-self-resetting thermal cut-out. Except as noted, the construction is otherwise comparable or identical. Identical parts carry the same reference numerals, while comparable parts are followed by the letter a. Instead of an adjustment shaft which can be adjusted in operation, the casing has an adjusting screw 16*a*, which acts on the expansion element 18 and sets the thermal cut-out to a constant temperature. Lever 22*a* directly carries the pressure pieces 27 and has a setting screw 55 at its end. The setting screw acts on a two-armed, spring-loaded lever 56, which is mounted on the casing and whose other end carries an operating piece 57. Operating piece 57 serves to forcibly disconnect the contact 47 of the catch spring, if the lever pivots counterclockwise as a result of an extreme contraction of the expansion box in the case of a capillary tube break or a leak in the hydraulic system (direction of arrow 58).

The casing also carries a pressure operating pin 59, which is offset for space saving reasons and whose end brings the catch springs or contact 47 back into the "on" position by means of a transmission strip 60, following the operation of the thermal cut-out. In this case, the snap switch is designed in such a way that, when it has switched off, it does not switch itself on again even in the case of a temperature drop and is in fact only switched on following the operation of operating knob 59. In the case of an identical construction of the snap switch base 40, the switch module only differs from that according to FIGS. 1 and 2 in that it has corresponding recesses for the transmission strip 60 and that it does not have the third flat tongue 43, because in place of the third flat tongue there is only an unconnected abutment. Thus, three different components are used, which permit other combinations of temperature controls. Once again, single-pole or multipole constructions are possible and e.g. in the case of a single-pole regulator, probably only the central holder 37 will be occupied. The casing can be constructed for the juxtapositioning of a random number of snap switch bases.

What is claimed is:

1. A modular temperature control apparatus, comprising:

a casing defining a plurality of modular holding means for snap switches;

at least one preassembled modular snap switch mountable in any one of the modular holding means formed in the casing, each modular snap switch comprising a separate insulating base and coacting switch parts mounted on the base, the switch parts defining at least one pole of the temperature control apparatus; and, a common snap switch operating means disposed in the casing, the operating means comprising an expansion element and a transmission mechanism for acting on each modular snap switch mounted in one of the modular holding means, whereby different numbers of the preassembled modular snap switches can be independently mounted one each in the modular holding means to form single and multipole control apparatus in the same casing.

2. A temperature control apparatus according to claim 1, wherein the common operating means is constructed as an interchangeable module and the casing defines modular means for receiving any of the modular operating means.

3. A temperature control apparatus according to claim 1, wherein the modular holding means comprises walls of the casing forming a plurality of identical open-topped receptacles on one side of the casing, each of the modular snap switches being insertable into any one of the receptacles through its open top, the separate base of each of the snap switches sealing that receptacle into which the snap switch is inserted.

4. A temperature control apparatus according to claim 1, wherein each of the modular snap switches comprises terminals for external connection of the coacting switch parts, the terminals being mounted on the base.

5. A temperature control apparatus according to claim 4, wherein the coacting switch parts are mounted on one side of the base and flat connecting tongues forming the terminals project from the other side of the base.

6. A temperature control apparatus according to claim 1, wherein the casing comprises tongue portions adapted to engage opposite ends of the base of any modular snap switch and so secure the modular snap switch in one of the modular holding means.

7. A temperature control apparatus according to claim 1, wherein the transmission mechanism comprises a plate-like lever fitted to the expansion element and a transmission pressure piece disposed between the plate-like lever and each modular snap switch mounted in the casing.

8. A temperature control apparatus according to claim 7, further comprising a comb-like spring plate, having a plurality of spring tongues, arranged parallel to and movable by the plate-like lever, each of the transmission pressure pieces being fitted to one of the spring tongues, and means for adjusting the the spring plate relative to the plate-like lever.

9. A temperature control apparatus according to claim 1, further comprising a safety switch for resetting at least one of the modular snap switches.

10. A temperature control apparatus according to claim 1, further comprising a manually actuable means for regulating the expansion element.

11. A temperature control apparatus according to claim 1, further comprising an auxiliary transmission lever for activating at least one modular snap switch mounted in the casing responsive to failure of a temperature sensing system to which the expansion element is connected.

12. A temperature control apparatus according to claim 1, wherein the holding means are narrow, elongated and juxtaposed parallel to one another, and the base of each of the modular snap switches is of corresponding size and dimension.

13. A temperature control apparatus according to claim 1, wherein a portion of the base of each modular snap switch mounted in the casing at least partly surrounds the casing.

* * * * *

UNITED STATES PATENT AND TRADEMARK OFFICE

CERTIFICATE OF CORRECTION

PATENT NO. : 4,565,989

DATED : January 21, 1986

INVENTOR(S) : Bruno Lotter, Willi Essig, Hans Mayer

It is certified that error appears in the above-identified patent and that said Letters Patent is hereby corrected as shown below:

Column 4, line 52 delete "control" and insert --central--.

Column 6, line 44 delete "the" (second occurrence).

Signed and Sealed this

*Sixteenth* Day of *September 1986*

[SEAL]

*Attest:*

DONALD J. QUIGG

*Attesting Officer*

*Commissioner of Patents and Trademarks*